US006572482B1

(12) United States Patent
Lewis, Jr.

(10) Patent No.: US 6,572,482 B1
(45) Date of Patent: Jun. 3, 2003

(54) RADIO FREQUENCY CONTROLLED TETHERED AIRCRAFT

(76) Inventor: Thomas J. Lewis, Jr., 134 Peregrine Ct., Jacksonville, FL (US) 32225

( * ) Notice: Subject to any disclaimer, the term of this patent is extended or adjusted under 35 U.S.C. 154(b) by 0 days.

(21) Appl. No.: 10/102,286

(22) Filed: Mar. 20, 2002

(51) Int. Cl.[7] ..... A63H 13/20
(52) U.S. Cl. ..... 472/9; 472/10; 446/31
(58) Field of Search ..... 472/6, 7, 8, 9, 472/10, 11, 12; 446/30, 31, 32, 33

(56) References Cited

U.S. PATENT DOCUMENTS

| | | | | | |
|---|---|---|---|---|---|
| 1,769,414 | A | | 7/1930 | Brandon et al. | |
| 1,802,139 | A | * | 4/1931 | Dacey, Jr. | 472/9 |
| 1,819,483 | A | | 8/1931 | Rittenhouse | |
| 2,075,267 | A | * | 3/1937 | Christiansen | 446/30 |
| 2,977,177 | A | | 3/1961 | Taylor | |
| 3,022,070 | A | | 2/1962 | Schlau | |
| 3,030,733 | A | | 4/1962 | Crawford | |
| 3,371,424 | A | | 3/1968 | Sweet | |
| 3,548,535 | A | * | 12/1970 | Bryan | 472/10 |
| 3,556,520 | A | * | 1/1971 | Hunt | 446/32 |
| 3,686,514 | A | | 8/1972 | Dube et al. | |
| 3,705,720 | A | * | 12/1972 | Nicholls | 472/9 |
| 3,740,032 | A | * | 6/1973 | Chang | 472/9 |
| 3,743,279 | A | * | 7/1973 | Chang | 446/30 |
| 3,762,702 | A | | 10/1973 | Keele et al. | |
| 4,135,711 | A | | 1/1979 | Holt | |
| 5,816,877 | A | * | 10/1998 | Chuang | 446/31 |

* cited by examiner

*Primary Examiner*—Kien T. Nguyen
(74) *Attorney, Agent, or Firm*—Michael I. Kroll

(57) ABSTRACT

The present invention 10 discloses a model aircraft 14 for preventing the fouling of control lines for tethered aircraft controlled by means of radio frequency transmission 12. The present invention 10 has a coupling 22 for model aircraft attached by a semi rigid conduit 20 to a base control unit 18. The rigid conduit 20 is a composite material tube providing anti-sway control. The tube 20 houses a lubricant and drive cable 40 connected to a coupling 22 connecting the aircraft 14 to the base control unit 18 whereby various aircraft may be substituted. At the other distal end the semi-rigid member is removably secured to a drive module housing the drive motor 36 that forms part of the base control unit 18. The base module 18 houses a power supply 52, receiver 48, servo motor 50 and speed control 46. A hand held remote control 12 unit is used to transmit control signals for the aircraft elevator control and prop speed. Because of the coupling 22 the aircraft is able to rotate 360 degrees at any point in the flight path 102 in addition to performing various stunt maneuvers such as tail wags, stalls, inverted flight, loops, flips and much more.

13 Claims, 16 Drawing Sheets

BLOCK DIAGRAM OF THE PRESENT INVENTION

RADIO FREQUENCY CONTROLLED TETHERED AIRCRAFT

BACKGROUND OF THE INVENTION

1. Field of the Invention

The present invention relates generally to model aircraft and more specifically to a device for preventing the fouling of control lines for tethered aircraft controlled by means of radio frequency transmission. The device of the present invention is a coupling for model aircraft attached by a semi rigid conduit to a base control unit. The rigid conduit is a composite material tube providing anti-sway control. The tube houses a lubricant and drive cable connected to a coupling connecting the aircraft to the base control unit. The rigid conduit has an attachable/detachable coupling that mates with the aircraft attachable/detachable aircraft coupling whereby various aircraft may be substituted. At the other distal end the rigid member is removably secured to a drive module housing the drive motor that forms part of the base control unit.

With the aircraft removed the drive motor/rigid conduit member extends in a vertical orientation. When the aircraft is attached the rigid member extends in the horizontal plane.

The base module houses a power supply, RF receiver servo motor and speed control. A hand held remote control unit is used to transmit control signals for the aircraft elevator control and prop speed.

Because of the coupling the aircraft is able to rotate 360° at any point in the flight path in addition to performing various stunt maneuvers such as tail wags, stalls, inverted flight, loops, flips and much more. The fuselage of the aircraft is constructed of a durable material that can sustain a crash without damaging the fuselage or wing stations of the aircraft.

2. Description of the Prior Art

There are other tethered or controlled toy aircraft designed to improve the tethered line application of flight. Typical of these is U.S. Pat. No. 1,769,414 issued to Brandon et al. on Jul. 1, 1930.

Another patent was issued to Rittenhouse on Aug. 18, 1931 as U.S. Pat. No. 1,819,483. Yet another U.S. Pat. No. 2,977,117 was issued to Taylor on Mar. 28, 1961 and still yet another was issued on Feb. 20, 1962 to Schlau as U.S. Pat. No. 3,022,070.

Another patent was issued to Crawford on Apr. 24, 1962 as U.S. Pat. No. 3,030,733. Another patent was issued to Dube et al on Aug. 22, 1972 as U.S. Pat. No. 3,686,514. Another patent was issued to Meyer on May 8, 1973 as U.S. Pat. No. 3,731,424. Another patent was issued to Keele et al on Oct. 2, 1973 as U.S. Pat. No. 3,762,702. Another patent was issued to Holt on Jan. 23, 1979 as U.S. Pat. No. 4,135,711.

U.S. Pat. No. 1,769,414

Inventor: T. B. Brandon

Issued: Jul. 1, 1930

The invention relates to aerial advertising devices of the captive balloon or airplane type and has for its principal object to provide an article of this character suspended from an overhead support permitting the movement of the airplane in a circular path beneath the support mechanism.

U.S. Pat. No. 1,819,483

Inventor: Arther E. Rittenhouse

Issued: Aug. 18, 1931

This invention relates to improvements in toys, and has for its principal object to provide a mechanical toy adapted to swing in circles about the base of a flexible anchor or support to which it is secured.

U.S. Pat. No. 2,977,117

Inventor: William H. Taylor

Issued: Mar. 28, 1961

The invention relates to devices for controlling the flight of tethered model aircraft and, more particularly to devices enabling the user to control the aircraft from a location outside the flight circle.

U.S. Pat. No. 3,022,070

Inventor: Floyd E. Schlau

Issued: Feb. 20, 1962

The invention relates to a tethered toy and pylon or anchor therefor and has for its principal object the provision of a novel and improved tethered toy and power pylon in which power for propelling the toy is supplied by means carried by the pylon and transmitted to the motor equipped toy to cause the toy to travel a circular path determined by the length of the tether which is anchored at one end to the toy and at the other end to the pylon by a suitable pivot or swivel.

U.S. Pat. No. 3,030,733

Inventor: Arther R. Crawford

Issued: Apr. 24, 1962

This invention relates to toy aircraft of the power driven type capable of sustained flight and is commonly tethered by means of a strong cable, the end of which is held and controlled by the operator to cause the aircraft to fly in closed circles.

U.S. Pat. No. 3,686,514

Inventor: Milford J. Dube et al.

Issued: Aug. 22, 1972

A slip ring assembly employs an elongated shaft which has a number of axially extending surface channels about its circumference and which has mounted thereon a number of contact sets consisting of an annular spacer and a contact member. Each contact member has an element projecting into one of the channels and connected to a lead wire seated therein, and each contact member has at least a portion of its external surface paretically exposed for electrical contact by an external member.

U.S. Pat. No. 3,731,424

Inventor: Burton C. Meyer

Issued: May 8, 1973

An amusement device which includes a craft, such as a model airplane, attached by a power cable and a tethering line to a control means which includes an upright general hollow support pylon for tethered flying of the craft about the pylon. The tethering line is threaded for free movement through the hollow pylon, extends from the top thereof for connection to the craft, and extends from the bottom thereof for manipulation whereby the flight of the craft may be controlled simply by pulling in or paying out the tethered line.

U.S. Pat. No. 3,762,702

Inventor: Eldon R. Keele et al.

Issued: Oct. 2, 1973

A remotely controlled tethered toy in which a pair of airplanes are suspended from individual arms, the arms being individually rotatably coupled to the top of a pylon with electrical power being supplied to electric motors in each of the toys through slip rings and a pair of individually controlled switches.

U.S. Pat. No. 4,135,711

Inventor: Ralph J. Holt

Issued: Jan. 23, 1979

An electrically powered tethered model airplane connected to a central post or pylon. The tether line is also the electrical wire to supply power to the electrical motor in the airplane that drives the propeller. The airplane assembly typically has two airplanes connected to the central pylon. A unique connection arrangement at the interface of the tether lines and central pylon allows not only for electrical contact, but also for circular movement of the tether lines and planes around the pylon without becoming wrapped or wound on the pylon. Two transformers are connected to the electrical connection at the top of the pylon, enabling two operators to control their respective airplanes for various maneuvers.

SUMMARY OF THE PRESENT INVENTION

The present invention discloses a model aircraft for preventing the fouling of control lines for tethered aircraft controlled by means of radio frequency transmission. The present invention has a coupling for model aircraft attached by a semi rigid conduit to a base control unit. The rigid conduit is a composite material tube providing anti-sway control. The tube houses a lubricant and drive cable connected to a coupling connecting the aircraft to the base control unit. The rigid conduit has an attachable/detachable coupling that mates with the aircraft having an attachable/detachable aircraft coupling whereby various aircraft may be substituted. At the other distal end the rigid member is removably secured to a drive module housing the drive motor that forms part of the base control unit. The base module houses a power supply, receiver, servo motor and speed control. A hand held remote control unit is used to transmit control signals for the aircraft elevator control and prop speed. Because of the coupling the aircraft is able to rotate 360 degrees at any point in the flight path in addition to performing various stunt maneuvers such as tail wags, stalls, inverted flight, loops, flips and much more.

A primary object of the present invention is to provide a radio frequency operated tethered aircraft.

Another object of the present invention is to provide a radio frequency transmitter that sends signals to a receiver device located within a base unit.

Yet another object of the present invention is to provide a radio frequency control line style flight device where a signal is sent from a transmitter to a receiver within a base unit and via cables to the aircraft.

Still yet another object of the present invention is to provide a radio frequency operated tethered aircraft that consists of a base unit controlling a model aircraft that flies in a dome motion around the base unit.

Yet another object of the present invention is to provide a radio frequency operated tethered aircraft having a base unit consisting of a servo motor, battery, receiver, drive motor, spring, drive cable, elevator cable, and semi rigid conduit.

Yet another object of the present invention is to provide a radio frequency operated tethered aircraft having a base unit with a drive motor connected to a carbon fiber tube. The carbon fiber tube contains a drive control cable which delivers rotational forces to the propeller and an exteriorly attached elevator cable connected to the aircraft elevator flap.

Additional objects of the present invention will appear as the description proceeds.

The present invention overcomes the shortcomings of the prior art by providing a radio frequency transmitter that sends signals to a receiver device located within a base unit that controls a line style flight device via cables to the aircraft. Also providing a tethered aircraft that flies in a dome motion around the base unit.

In addition a radio frequency operated tethered aircraft having a base unit containing two servo motors, a battery, receiver and a drive motor. The drive motor is located at one distal end of the carbon fiber tube. Within the carbon fiber tube runs a drive control cable extending to the propeller and the elevator on the aircraft.

The present invention also provides a quick release for exchanging types of aircraft. The aircraft are constructed of a durable material that can sustain a crash without damaging the fuselage or wing stations of the aircraft.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claim.

LIST OF REFERENCE NUMERALS

Figure 1:
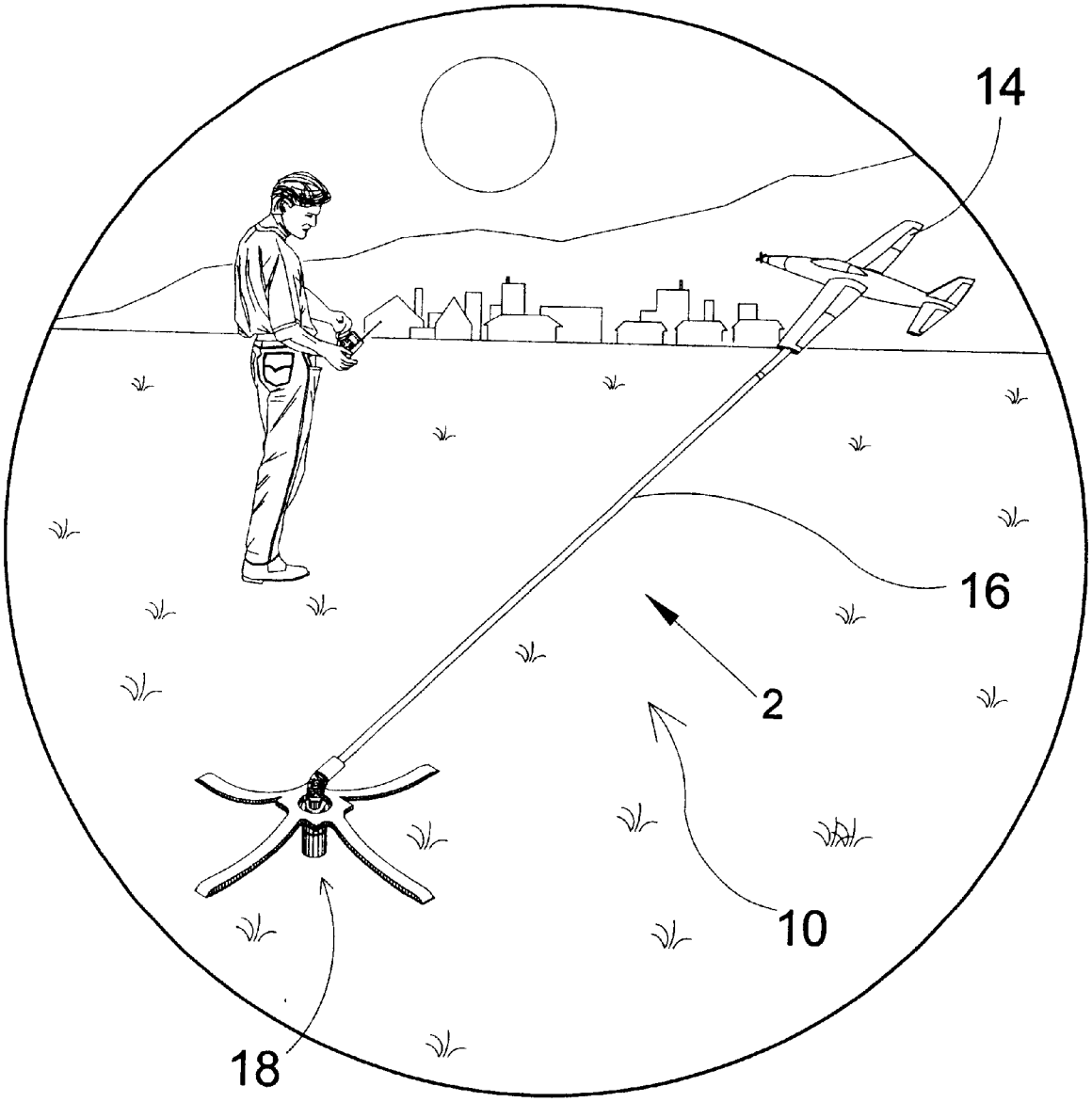
FIG. 1 is a perspective view of the present invention in use.

With regard to reference numerals used, the following numbering is used throughout the drawings:

10 present invention
11 user
12 hand held remote control
14 aircraft
16 tether
18 base unit
20 semi rigid conduit
21 fiberglass anti-sway tube
22 connection
24 boot
26 servo motor
28 elevator cable
30 elevator control
32 base stand
34 electronic control module
36 drive motor
38 spring
40 drive cable
42 anti-sway/carbon tube motor mount
44 spring fastener
46 speed control
48 receiver
50 elevator control servo
52 battery
54 cable to motor adapter
56 elevator control case mount
58 set screw
60 drive cable and case
62 motor mount
64 upper cup
66 lower cup
67 elevator cable
68 elevator
69 prop drive cable
70 prop
72 wing mount block
74 prop mount
76 male connector
77 male connector
78 female connector
79 female connector
80 to base unit
82 female drive cable receiver
84 prop shaft
86 bearings
88 prop belt
90 attachment clips
92 elevator cable adjuster block
94 bearings
96 arrow
98 elevator cable disconnect
100 dome of operation
102 current movement path

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is a perspective view of the present invention 10 in use. The device of the present invention includes a radio frequency remote control unit 12 and an aircraft 14 tethered at 16 to a base control unit 18. The aircraft 14 has a dome shaped flight path and coupling means for causing the aircraft to rotate 360° substantially at any point within the dome-shaped flight path without tangling the flight control cables. Additionally, the aircraft 14 has control cables forming an integral part of the aircraft and quick connect couplings for attaching to the base unit 18 thereby enabling the quick substitution of various aircraft having similar integral control cables. This also provides for quick disassembly and storage of the components of the present invention 10.

Figure 2:
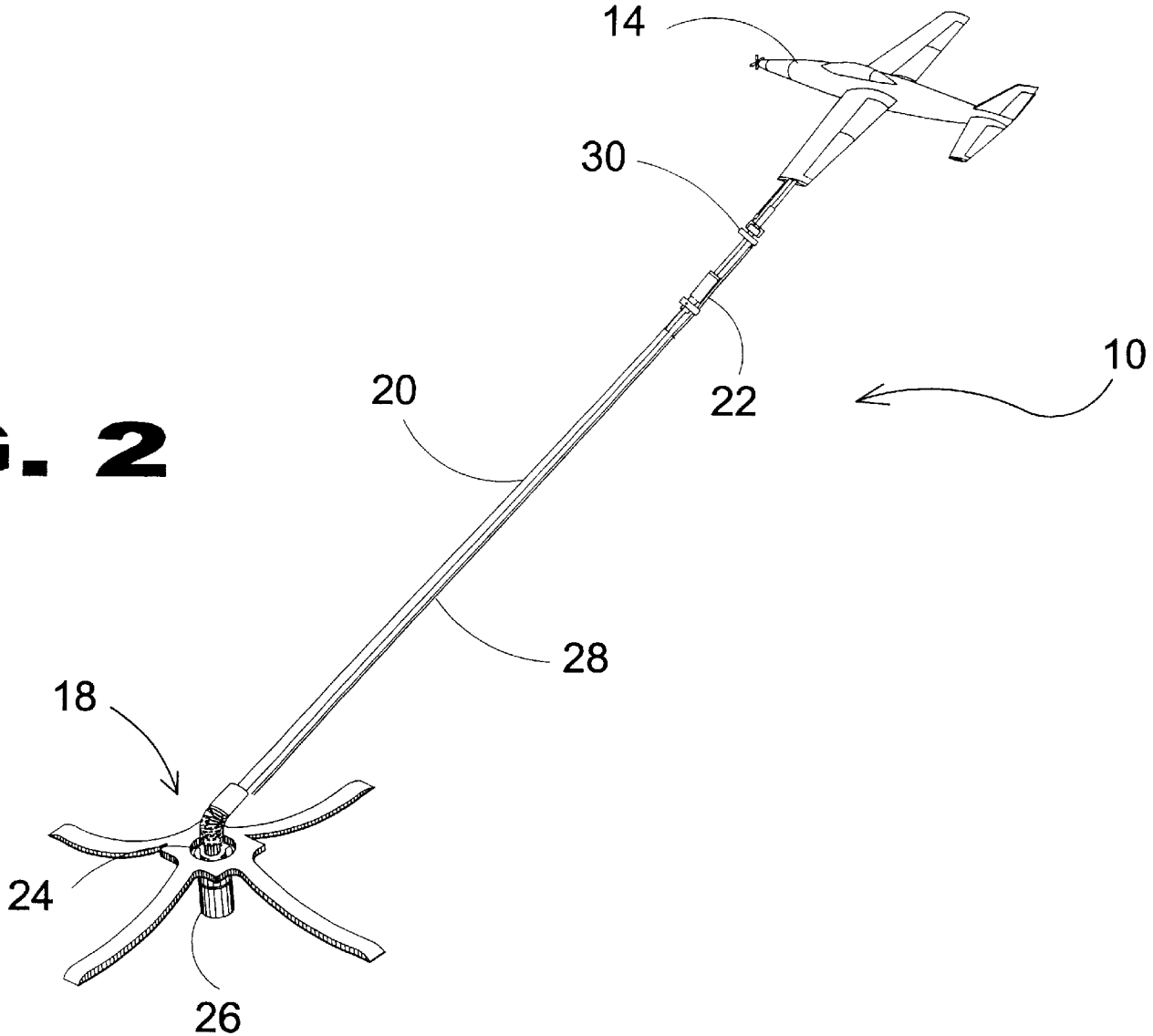
FIG. 2 is a perspective view of an aircraft of the present invention and the base control unit.

Turning to FIG. 2, shown therein is a perspective view of an aircraft 14 of the present invention 10 and the base control unit 18. The base unit 18 of the present invention 10 has all of the electronics housed within the base unit 18 and control cables extending along and through a semi rigid conduit 20 with quick connection elements 22 at the distal end whereby any aircraft 14 having integral control cables and wing mounted connection elements as defined by the present invention can be connected thereto. Also shown are the boot 24 and servo motor 26 of the base unit 18. The elevator cable 28 is also shown along with the elevator control 30.

Figure 3:
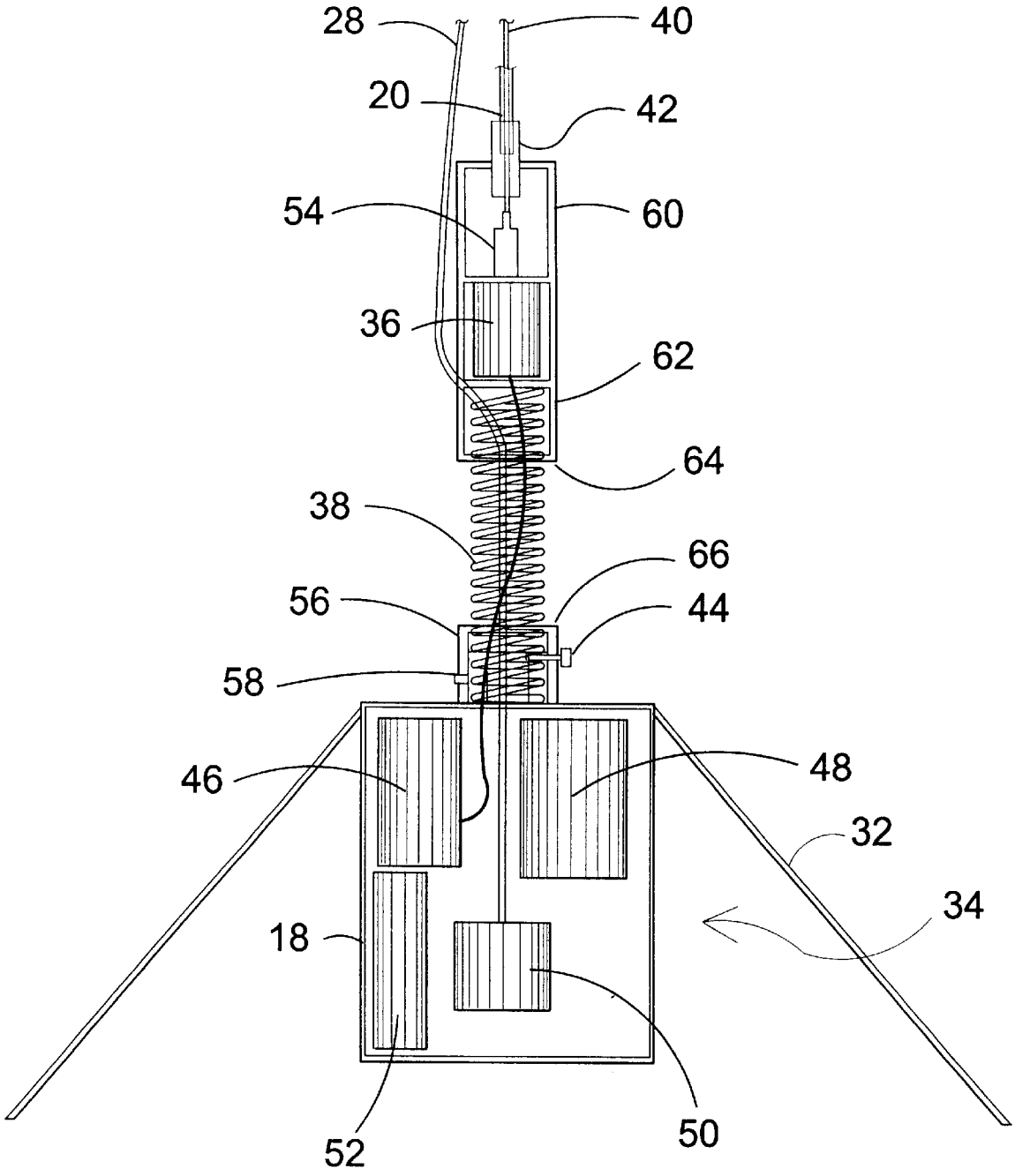
FIG. 3 is a cut away view of the base control unit of the present invention.

Turning to FIG. 3, shown therein is a cut away view of the base control unit 18 of the present invention. The base control unit 18 is comprised of a stand 32, electronic control module 34, drive motor 36, spring 38, drive cable 40, elevator cable 28 and a semi rigid conduit 20 being an anti-sway/carbon tube which is attached to a motor mount 42 having the anti-sway/carbon tube 20 therein. When assembled the drive cable 40 is inserted into the semi rigid conduit 20 which is secured to the base 18. The elevator cable 28 is clipped to the exterior of the semi rigid conduit 20. The tension of the spring 38 can be modified by rotation of the spring 38 which compresses and decompresses the amount of spring under the spring fastener 44. Also shown are a speed control 46, radio frequency receiver 48, elevator control servo 50, and battery power supply 52. Also shown are the cable to motor adapter 54, elevator control case mount 56, set screw 58, drive cable case 60, motor mount 62, and upper 64 and lower 66 cup.

Figure 4:
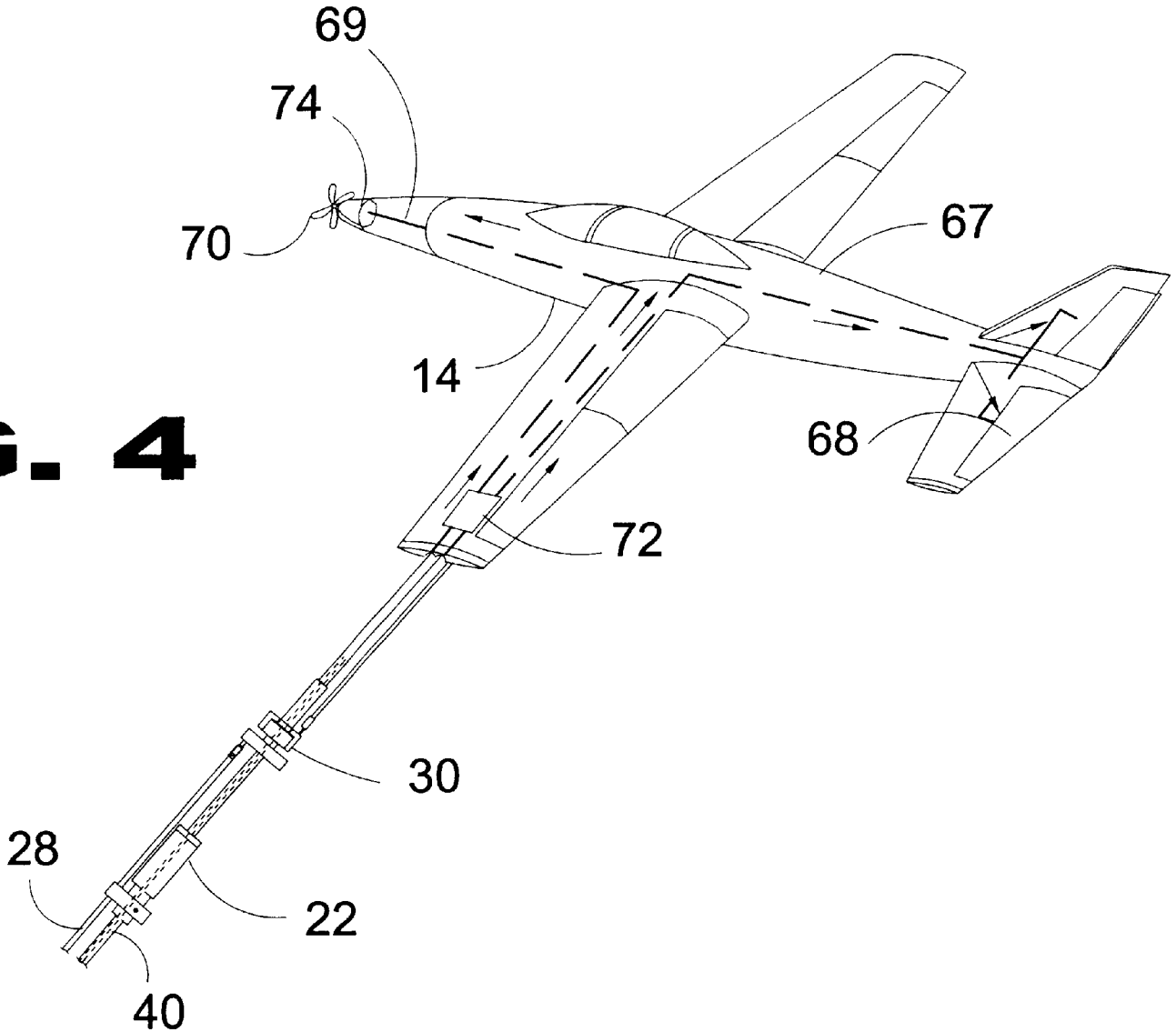
FIG. 4 is a detail view of an airplane of the present invention

Turning to FIG. 4, shown therein is a detail view of an airplane 14 of the present invention. The airplane 14 of the present invention has control cables 67, 69 forming an integral part of the aircraft for controlling the elevator flap 68 and rotation of the prop 70. These control cables extend from the aircraft wing mount block 72 and are connected by quick connect members 22 to the base control unit control cables 28, 40 extending from and attached to the semi rigid base unit conduit. Also shown are the prop mount 74 and elevator control 30.

Figure 5:
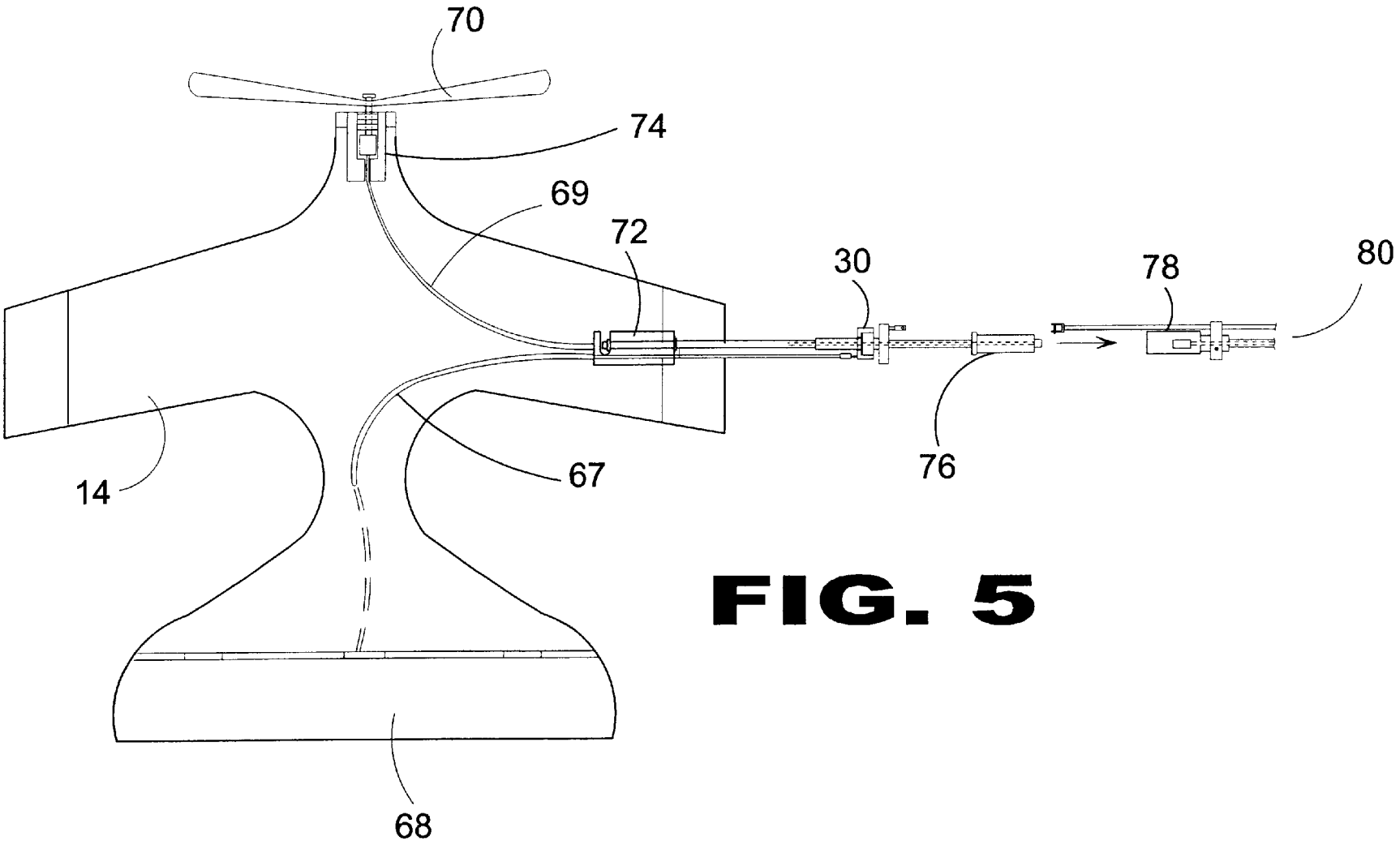
FIG. 5 is a detailed view of the airplane of the present invention.

Turning to FIG. 5, shown therein is a detailed view of the airplane 14 of the present invention. Shown is the airplane 14 having integral control cables 67, 69 extending from the elevator flap 68 and propeller 70 through a wing mount block 72 and terminating in male 76 and female 78 quick connection fasteners. Any aircraft having similar flight control cables 67, 69 forming an integral part of the aircraft and extending therefrom and having quick connection fasteners can be operated using the base control unit. Also shown are the mating quick connection fasteners 76, 78 extending toward the base control unit at 80. Also shown are the elevator control unit 30 and propeller shaft mount block 74.

Figure 6:
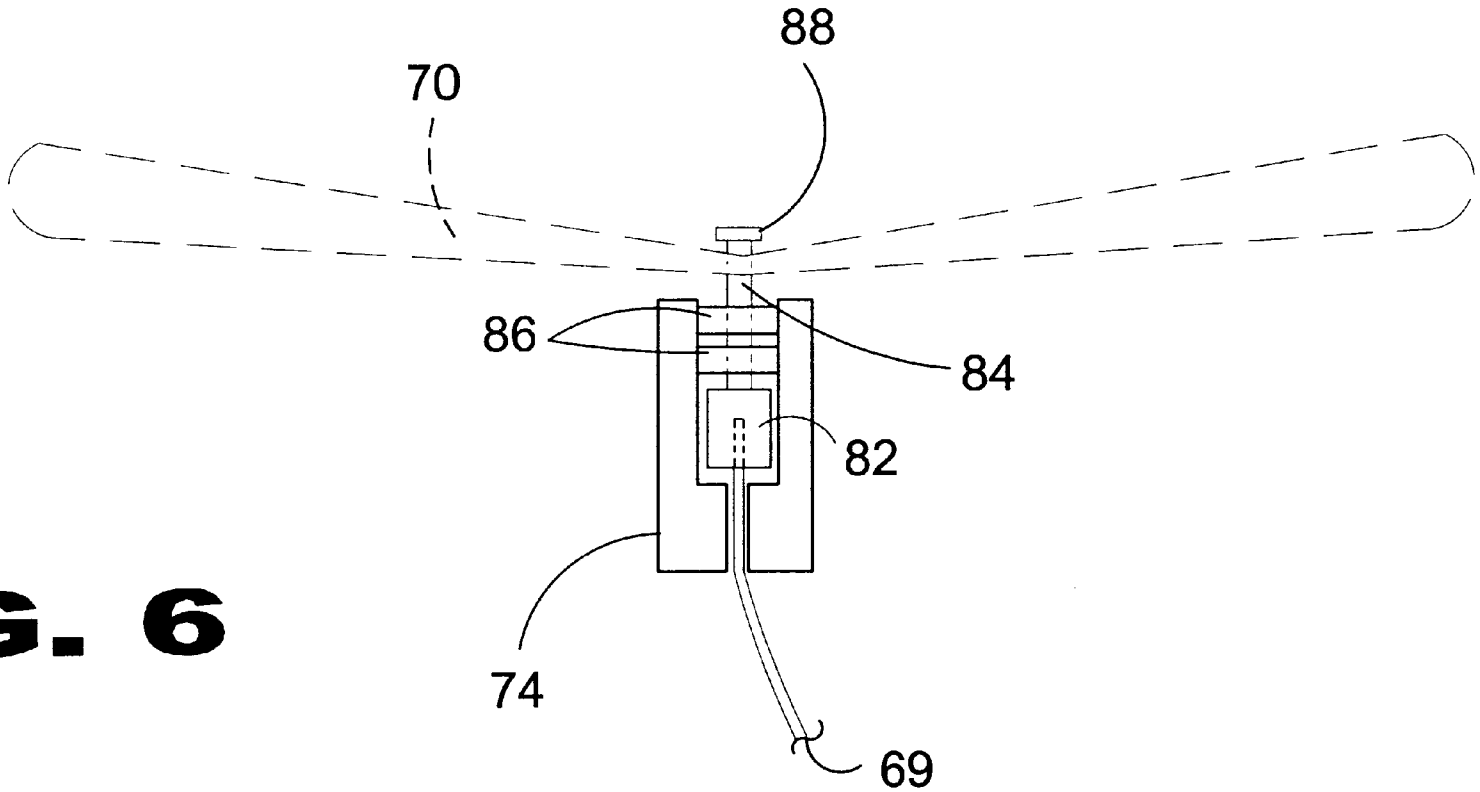
FIG. 6 is a detail view of the propeller shaft mount block.

Turning to FIG. 6, shown therein is a detail view of the propeller shaft mount block 74. The propeller shaft mounting block 74 is the structural interface member for the propeller 70 and drive cable 69. The drive cable 69 is frictionally held within the female receiver 82 of the mounting block 74. The propeller shaft 84 extends from the female receiver 82 through at least one bearing 86 counter sunk into the propeller shaft mounting bolt 88.

Figure 7:
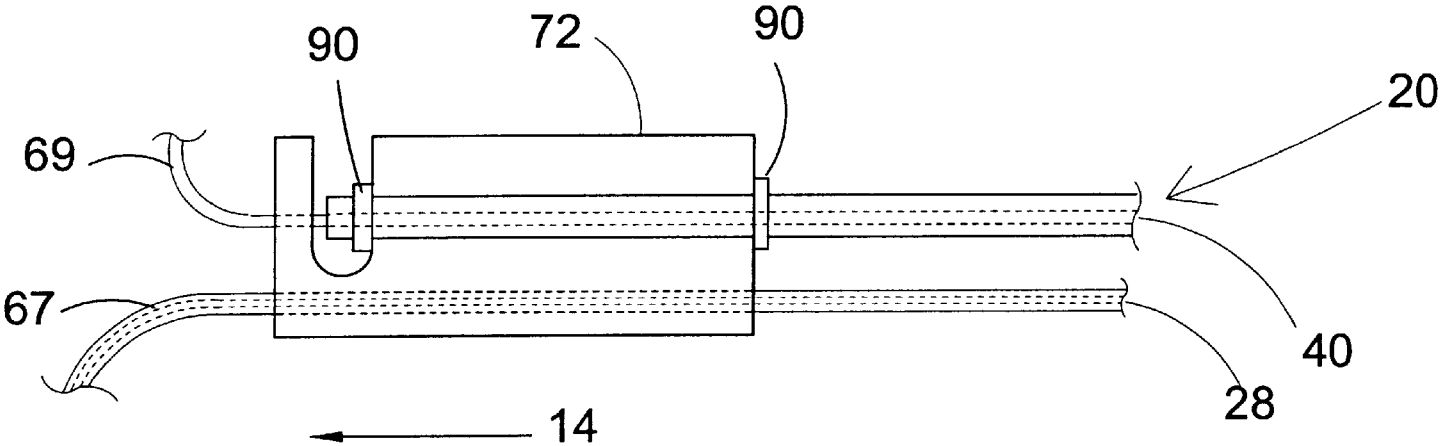
FIG. 7 is a detailed view of the wing mount block.

Turning to FIG. 7, shown therein is a detailed view of the wing mount block 72. The wing mount block 72 is the structural interface member for the drive cable 40 within the semi rigid conduit 20 and exteriorly attached elevator cable 28 of the base control unit. It provides the structural support for the control cables 67, 69 as the plane rotate 360° through selective manipulation of the elevator flaps. Attachment clips 90 are also shown.

Figure 8:
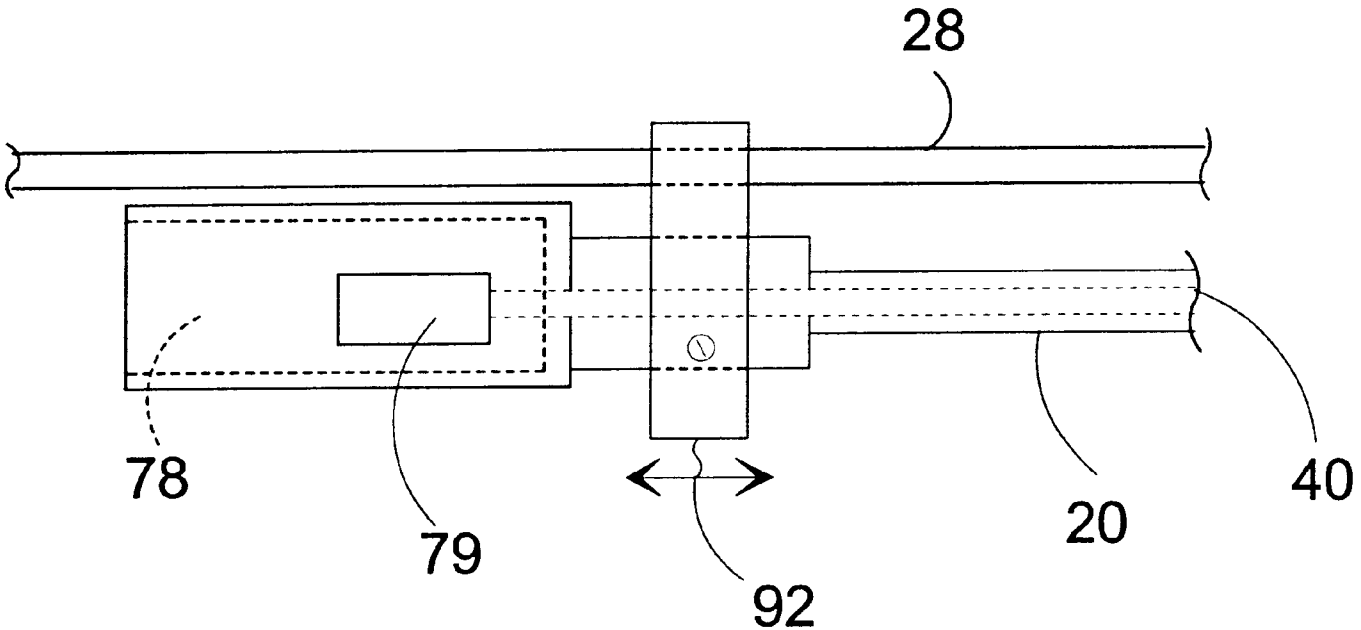
FIG. 8 is a detailed view of the female member of the drive cable quick disconnect.

Turning to FIG. 8, shown therein is a detailed view of the female member 78 of the drive cable quick disconnect. Shown is the female member 78 of the drive cable quick disconnect having a female connector 79 therein which is located on the distant end from the anti-sway/carbon fiber tube 20. Also shown is the sliding elevator cable adjuster block 92. The airplane has a drive cable 40 and elevator cable control unit 28 that are spaced for that particular plane. The adjuster block 92 provides for adjusting the elevator cable 28 to fit the airplane cable configuration.

Figure 9:
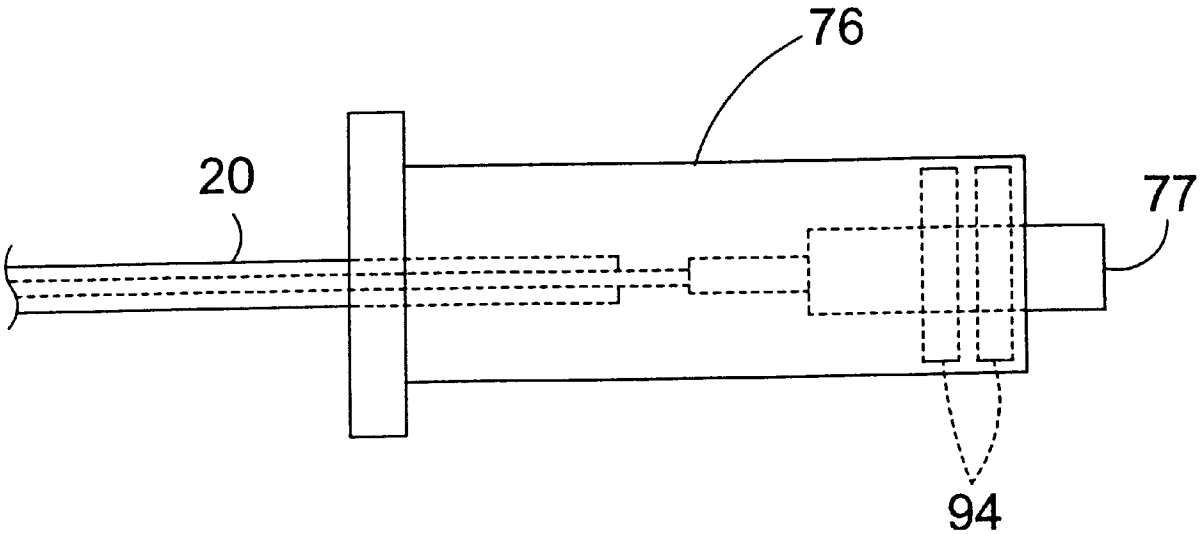
FIG. 9 is a detailed view of the drive cable quick disconnect.

Turning to FIG. 9, shown therein is a detailed view of the drive cable quick disconnect 76. The drive cable quick disconnect has a male connector member 77 that along with the wing mount block and elevator control unit is a selectively removable part of the airplane. It provides for the easy removal of the airplane from the anti-sway/carbon tube 20 to mount another airplane or dismantle for the present invention for storage purposes. Also shown are bearings 94

Figure 10:
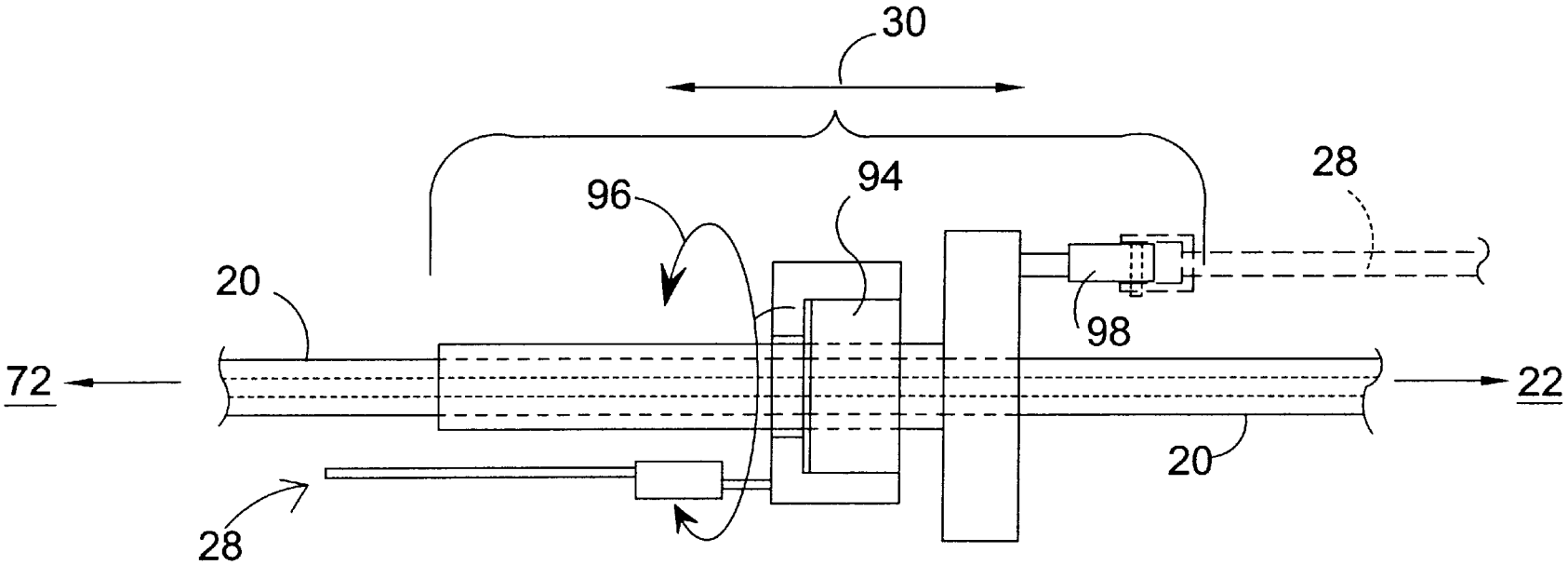
FIG. 10 is a detailed view of the sliding elevator control unit.

Turning to FIG. 10, shown therein is a detailed view of the sliding elevator control unit 30. The sliding elevator control unit 30 provides for 360° rotation shown at arrow 96 of the plane without tangling the elevator control cable 28. The elevator control cable quick disconnect 98 along with the drive cable disconnect 22 provides for changing planes having their own wing mounting block 72, sliding elevator control unit 30 with quick disconnect 98 and drive cable quick disconnect 22. Also shown are the carbon tube 20, bearing 94 which rotates with the plane and the elevator control cable 28.

Figure 11:
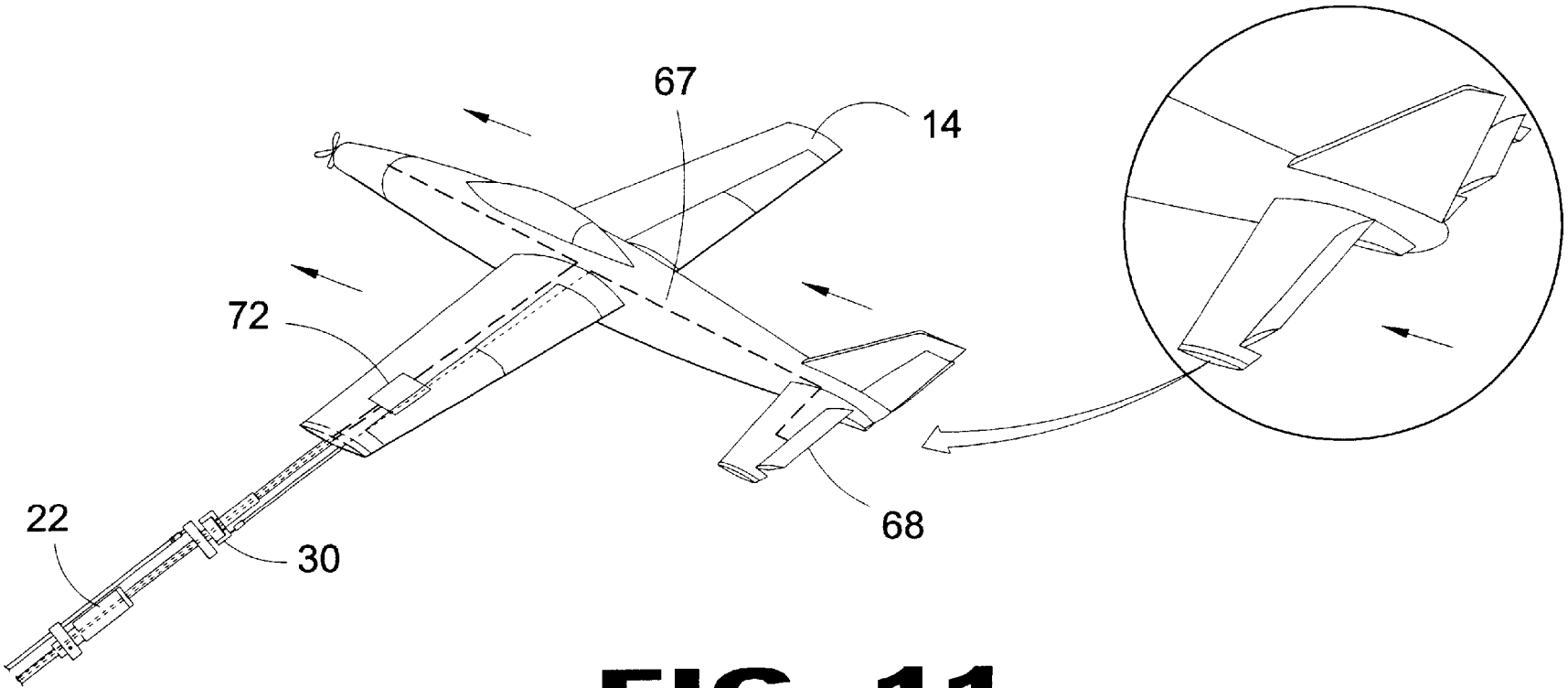
FIG. 11 is a detail view of an airplane of the present invention in use.

Turning to FIG. 11, shown therein is a detail view of an airplane 14 of the present invention in use. Shown is an airplane 14 of the present invention having the elevator flap 68 in a raised position 100 which will cause the airplane nose to elevate. Through manipulation of the elevator flap control mechanism 30 the plane can rotate at a fixed point within the dome flight pattern through 360°. Other elements previously disclosed are also shown.

Figure 12:
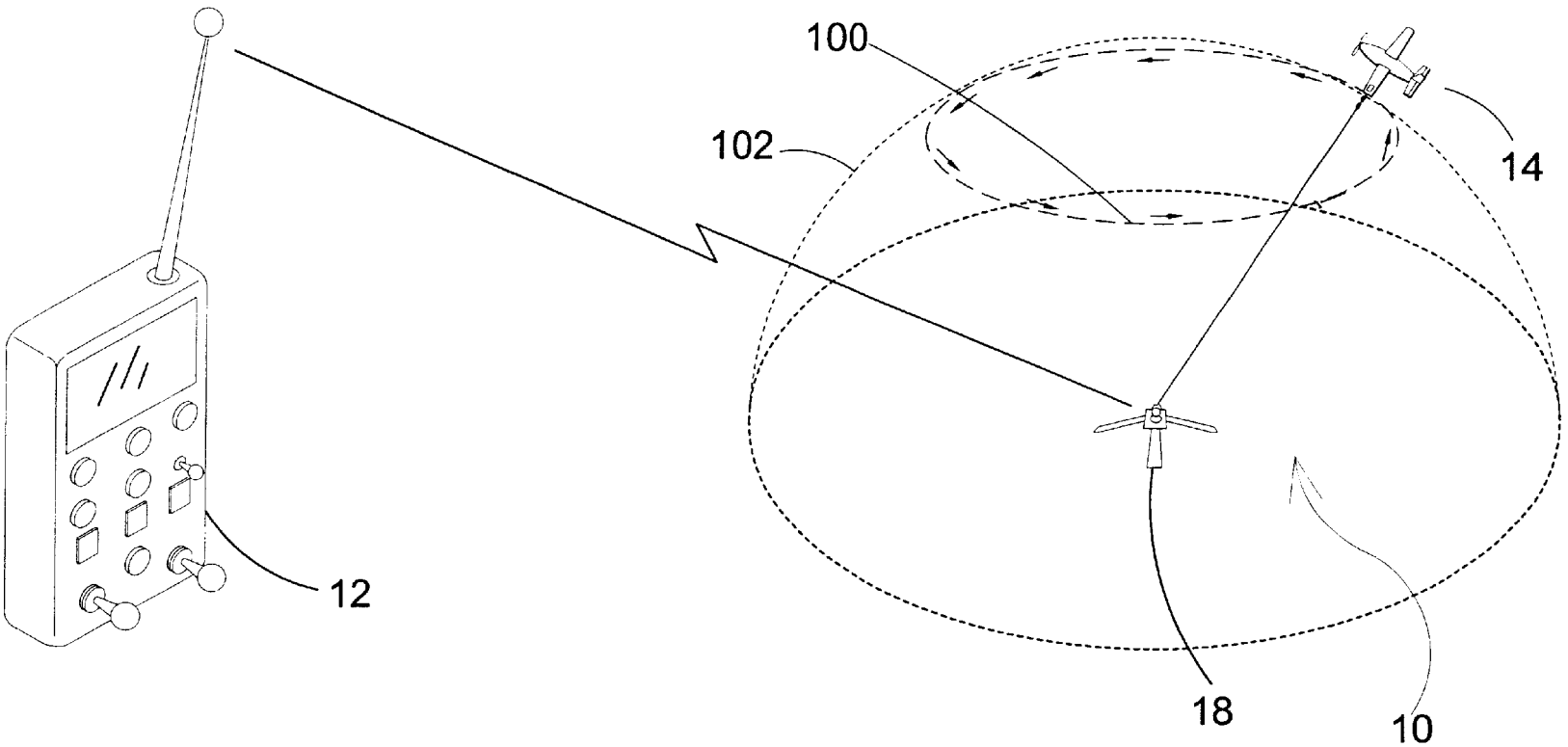
FIG. 12 is a perspective view of the present invention in use.

Turning to FIG. 12, shown therein is a perspective view of the present invention 10 in use. The radio frequency transmitter 12 of the present invention sends signals to the base unit 18, which comprises a receiver, servo motor, speed control unit, drive motor and battery as previously disclosed. This signal controls the plane 14 to fly within a dome of operation 100 by its current path of movement 102.

Figure 13:
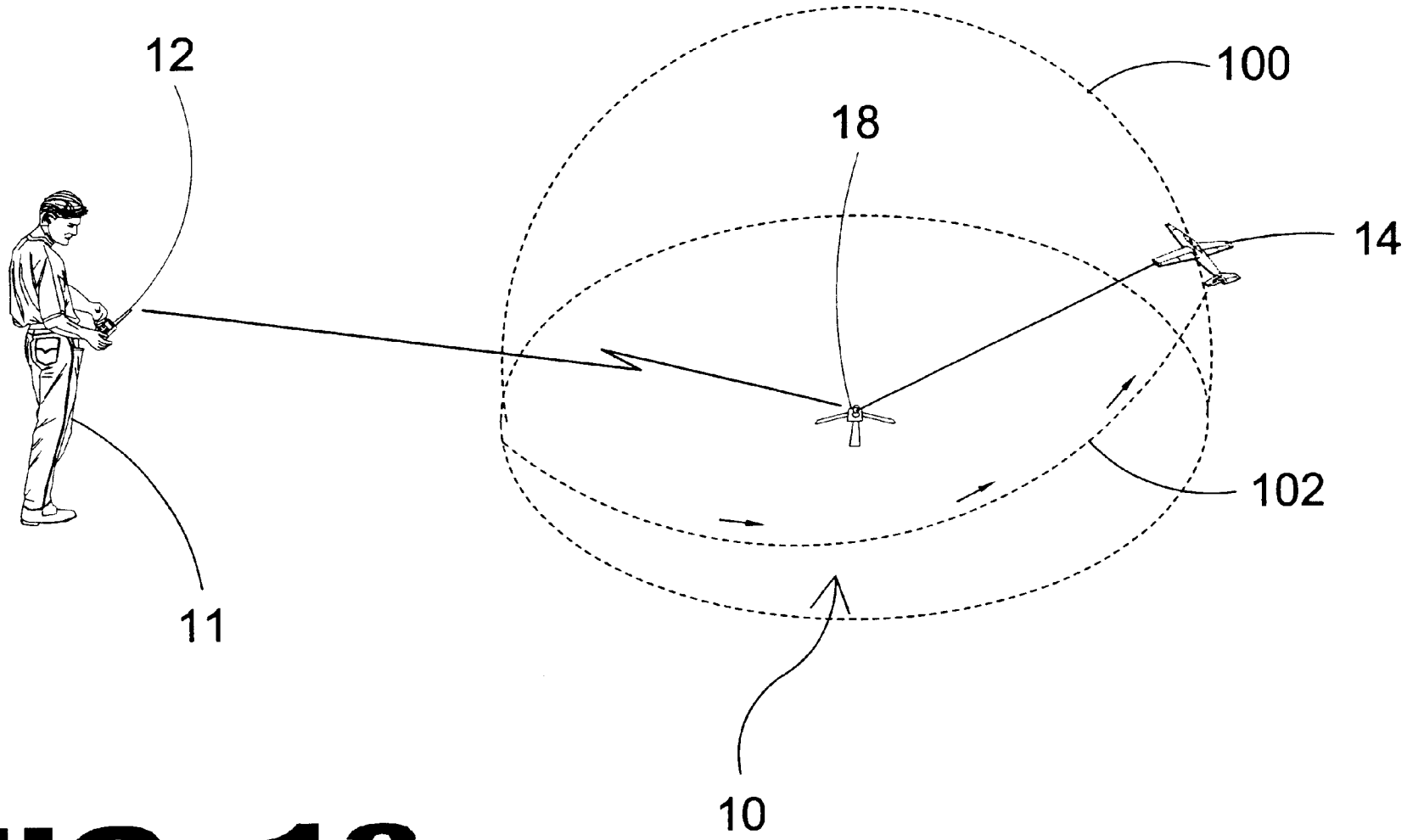
FIG. 13 is a perspective view of the present invention in use.

Turning to FIG. 13, shown therein is a perspective view of the present invention 10 in use. The device of the present invention 10, a control line style fight device is controlled by radio frequency transmission 12 from a hand held device. The user 11 controls the flight path 102 by manipulating the variables of speed and elevator flaps. Other elements previously disclosed are also shown.

Figure 14:
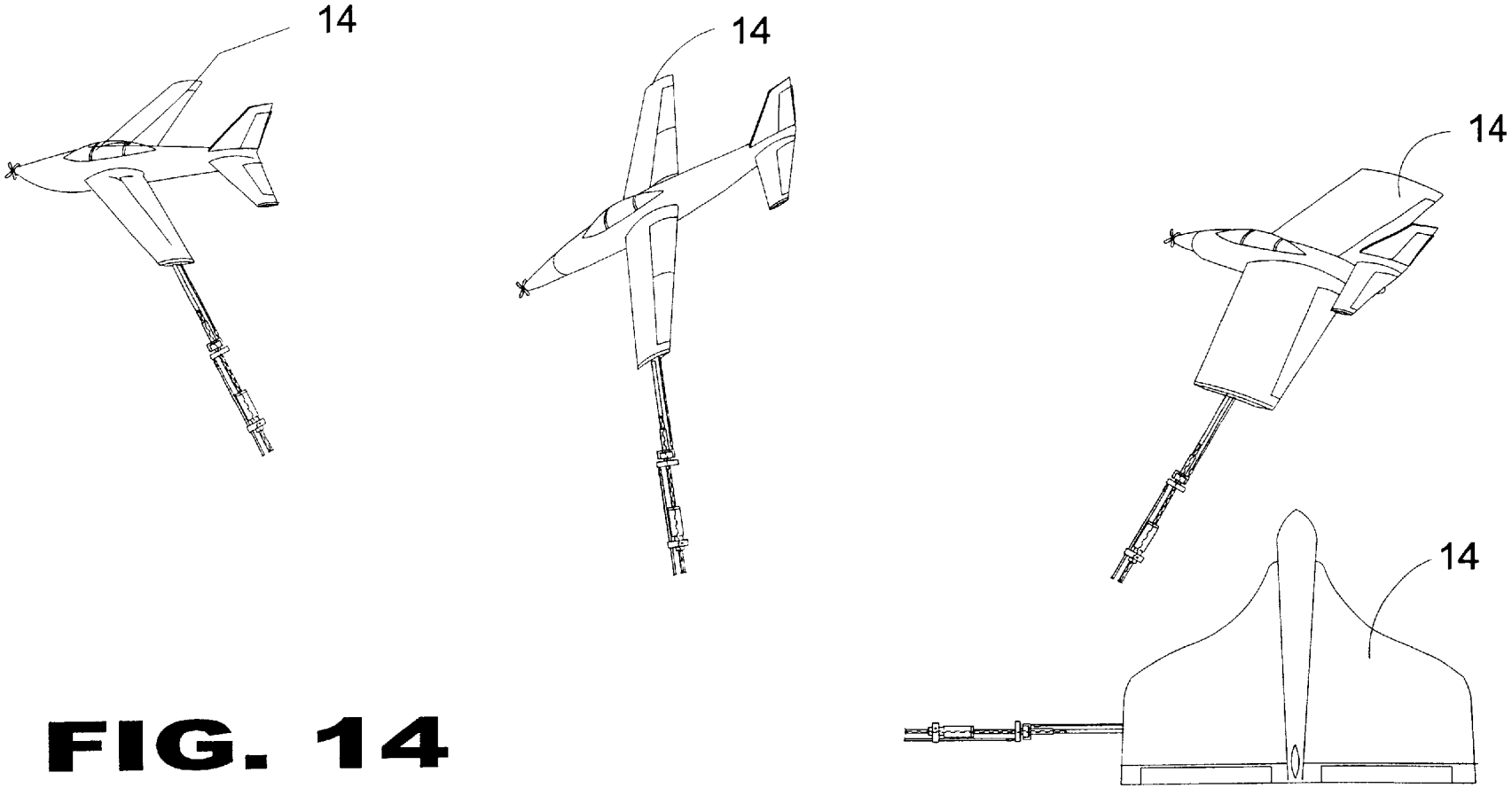
FIG. 14 is a perspective view of additional aircraft of the present invention.

Turning to FIG. 14, shown therein is a perspective view of additional different styles of aircraft 14 of the present invention. The aircraft 14 are interchangeable and are constructed of a durable material that can sustain a crash without damaging the fuselage or wing stations of the aircraft.

Figure 15:
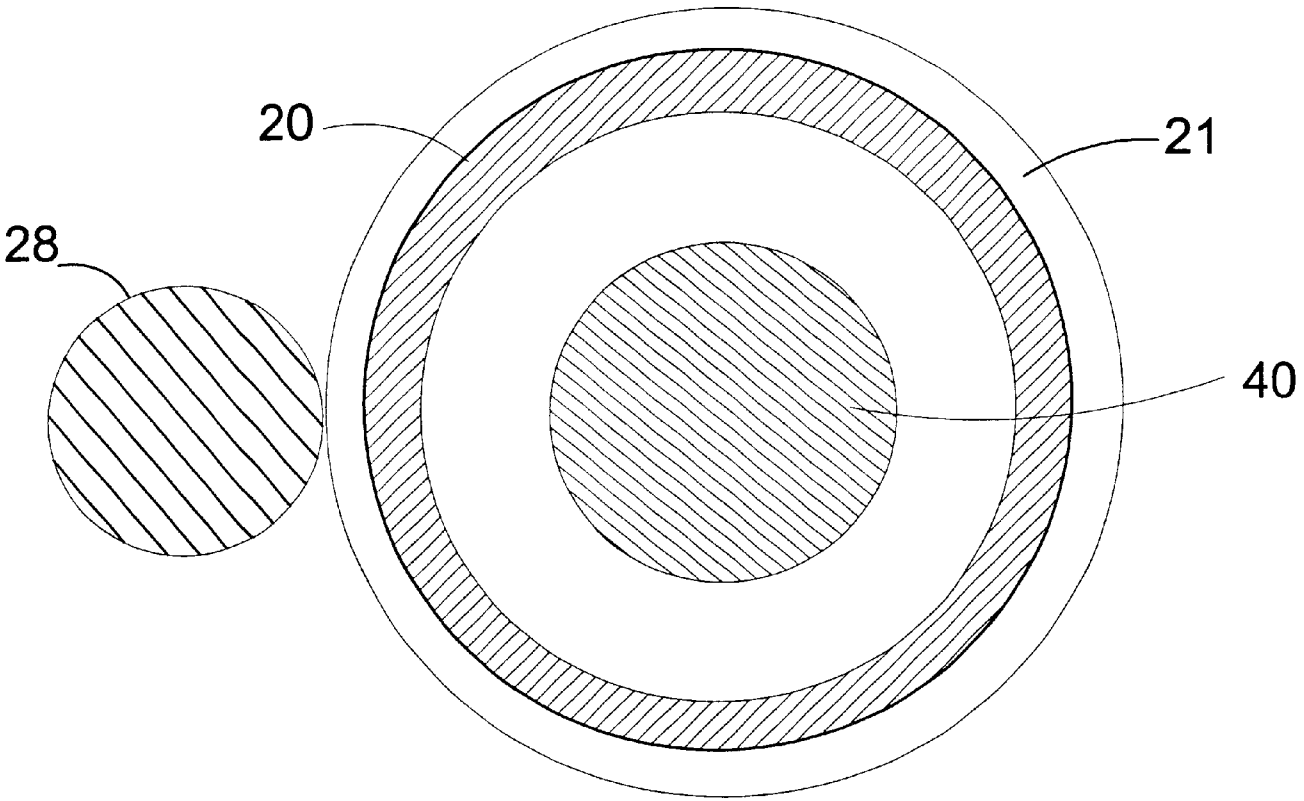
FIG. 15 is a control cable sectional view.

Turning to FIG. 15, shown therein is a control cable sectional view. Shown are the aircraft control cables. The drive cable 40 transfers the rotation of the motor to the propeller rotating within a carbon fiber tube 20 encased within a fiberglass anti-sway tube 21. The elevator cable 28 controls the pivoting of the elevator moving longitudinally with respect to the drive cable.

Figure 16:
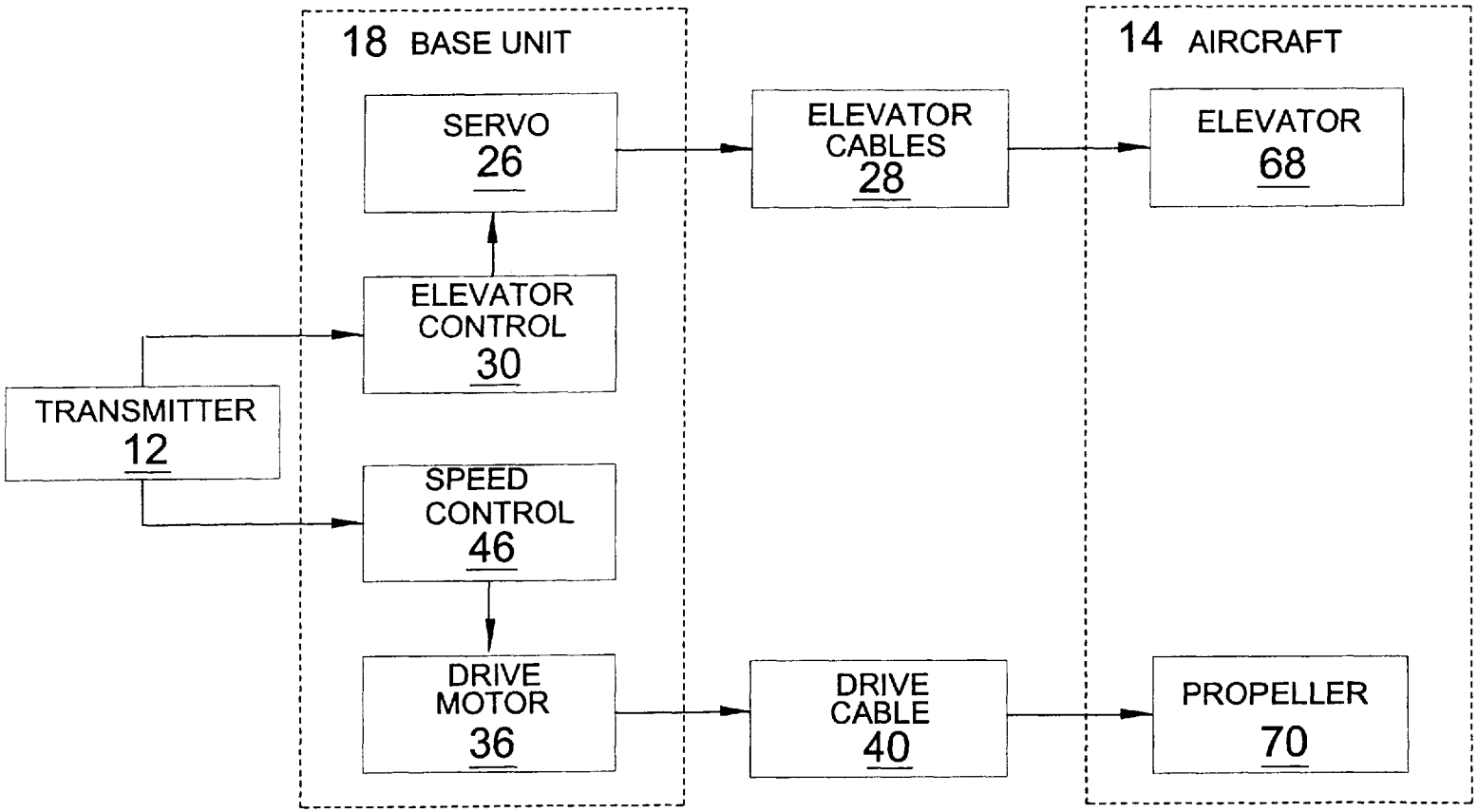
FIG. 16 is a block diagram of the present invention.

Turning to FIG. 16, shown therein is a block diagram of the present invention.

What is claimed to be new and desired to be protected by Letters Patent is set forth in the appended claims.

I claim:

1. An apparatus for a radio frequency controlled model airplane, comprising:

a) an airplane whereby the airplane has a propeller drive and elevator controls thereon;

b) a drive cable to permit the airplane propeller to be driven;

c) an elevator cable to permit the airplane elevator to be controlled;

d) a base control unit whereby the controls and power source for the airplane are disposed therein;

e) a semi-rigid tube whereby the airplane is tethered to the base control unit and controls and drive cable for the airplane are disposed therein;

f) means for connecting the airplane to said drive cable whereby the airplane may be quickly connected to or disconnected from the drive cable;

g) means for connecting the airplane to said elevator cable whereby the airplane may be quickly connected to or disconnected from the elevator cable; and, h) a hand held radio frequency transmitter to permit a user to control the airplane.

2. The apparatus of claim 1, wherein said base control unit comprises:

a) a base stand for supporting the unit;

b) a radio frequency receiver for receiving signals from a radio frequency transmitter;

c) an elevator cable control servo to permit the elevator cable to be controlled;

d) a drive motor disposed on said base stand for turning the drive cable;

e) a speed control for controlling the speed of the drive motor; and, f) a power supply for furnishing power to the unit.

3. The apparatus of claim 2, wherein said semi-rigid tube comprises:

a) a carbon fiber tube having said drive cable rotatably disposed therein;

b) a fiberglass anti-sway tube for encasing said carbon fiber tube; and, c) wherein said elevator cable is slidably disposed externally adjacent said fiberglass anti-sway tube.

4. The apparatus of claim 3, wherein said airplane comprises:

a) a propeller for pulling the airplane;

b) a shaft upon which said propeller turns; and, c) an internal propeller drive cable for turning the propeller;

d) a propeller shaft mounting block for connecting said internal propeller drive cable to said propeller;

e) an elevator for directing the airplane in a vertical plane;

f) an internal elevator cable for operating said elevator; and, g) a wing mount block disposed on the airplane wing for fixedly attaching said fiberglass anti-sway tube, said drive cable, and said elevator cable to the airplane.

5. The apparatus of claim 4, wherein said propeller shaft mounting block comprises:

a) a female drive cable receiver for receiving an end of said internal propeller drive cable;

b) a housing block for receiving said female drive cable receiver therein;

c) at least one bearing which surrounds said shaft, said bearing being fixedly disposed internal said housing block; and, d) a bolt for fastening said propeller to said shaft.

6. The apparatus of claim 5, wherein said means for connecting the airplane to the drive cable comprises:

a) a first female connector disposed on an end of said drive cable;

b) a first male connector disposed on an end of said drive cable for connection to said first female connector;

c) a second female connector rotatably disposed on an end of said drive cable internal said first female connector; and, d) a second male connector rotatably disposed on an end of said drive cable internal said first male connector, said second male connector for connection to said second female connection to permit quick connection or disconnection of the drive cable.

7. The apparatus of claim 6, wherein said first male connection further comprises at least one bearing surrounding said second male connection so that said second male connector is centrally rotatably disposed in said first male connection to permit cooperative alignment with said second female connection.

8. The apparatus of claim 7, wherein said first female connector further comprises a sliding elevator adjustor block disposed thereon to permit said block to slide along the outside of said first female connector to allow adjustment of said elevator cable.

9. The apparatus of claim 8, wherein said means for connecting the airplane to the elevator cable comprises:

a) an elevator control unit having a central housing, said housing having an aperture centrally disposed therein, said housing having a first end and a second end;

b) an elevator cable connector disposed on said first end of said housing to permit said elevator cable to be quickly connected thereto or disconnected therefrom;

c) wherein said aperture of said housing receives said fiberglass anti-sway tube to permit said central housing to slide upon said tube;

d) a rotatable bearing disposed about said central housing, said bearing disposed between said first and second ends of said central housing; and, e) wherein said elevator control cable is fixedly connected to said rotatable bearing to permit said elevator cable to rotate about said fiberglass anti-sway tube thereby preventing entanglement of said elevator cable and said anti-sway tube.

10. The apparatus of claim 9, wherein said wing mount block has a first and second aperture therein, said first aperture for receiving said fiberglass anti-sway tube and said second aperture for slidably receiving said elevator cable to permit said elevator cable to operate the airplane elevator.

11. The apparatus of claim 10, wherein the airplane is 360 degrees rotatable within the flight path of the airplane.

12. The apparatus of claim 11, wherein a plurality of airplanes types may be operated by the base control unit.

13. The apparatus of claim 12, wherein said carbon fiber tube contains lubricant wherein said drive cable rotates.

* * * * *